US009487934B1

(12) United States Patent
Davis et al.

(10) Patent No.: US 9,487,934 B1
(45) Date of Patent: Nov. 8, 2016

(54) FROST-FREE HYDRANT DRAINAGE SYSTEM

(71) Applicants: Robert D. Davis, Pavillion, WY (US); Bobbie J. Davis, Pavillion, WY (US)

(72) Inventors: Robert D. Davis, Pavillion, WY (US); Bobbie J. Davis, Pavillion, WY (US)

( * ) Notice: Subject to any disclaimer, the term of this patent is extended or adjusted under 35 U.S.C. 154(b) by 0 days.

(21) Appl. No.: 14/794,098

(22) Filed: Jul. 8, 2015

Related U.S. Application Data

(60) Provisional application No. 62/022,881, filed on Jul. 10, 2014.

(51) Int. Cl.
*E03B 9/14* (2006.01)
*E03B 7/12* (2006.01)

(52) U.S. Cl.
CPC . *E03B 9/14* (2013.01); *E03B 7/12* (2013.01); *Y10T 137/5503* (2015.04)

(58) Field of Classification Search
CPC ..... E03B 9/14; E03B 7/12; Y10T 137/5503
USPC ..... 137/301, 302, 377, 382
See application file for complete search history.

(56) References Cited

U.S. PATENT DOCUMENTS 836,400 A * 11/1906 Peak ..... E03B 9/04 137/291
2,730,326 A * 1/1956 Staben ..... E03B 9/20 137/302
4,854,339 A * 8/1989 Hoeptner, III ..... E03B 9/04 137/282
5,701,925 A * 12/1997 Mulligan et al. ..... E03B 9/02 137/119.05

* cited by examiner

*Primary Examiner* — Kevin Lee

(57) ABSTRACT

A hydrant drainage boot is installed around a water supply line and a frost-free hydrant to prevent dirt and debris from blocking the drainage port, and ensures unobstructed drainage of the hydrant. The frost-free hydrant has a linear riser pipe having a pipe top end and a pipe bottom end, a pivoting operating lever having a spigot a valve having a drain port, and a pipe connector. The hollow boot body has a first housing and a second housing attached to form a boot body with a boot cavity, base drainage slots, side drainage slots, water drainage louvers, raised louvers, and input and output ports. The hydrant drainage boot is enclosed around at least the valve, the pipe connector, a water supply line and a portion of the riser pipe of the frost-free hydrant.

20 Claims, 4 Drawing Sheets

FROST-FREE HYDRANT DRAINAGE SYSTEM

CROSS REFERENCE

This application claims priority to U.S. Provisional Patent Application No. 62/022,881 filed Jul. 10, 2014, the specification(s) of which is/are incorporated herein in their entirety by reference.

FIELD OF THE INVENTION

The present invention relates to frost-free hydrant systems, or more specifically, frost-free hydrant systems that prolong the life of the frost-free hydrant by ensuring reliable drainage of the hydrant

BACKGROUND OF THE INVENTION

Frost-free hydrants are convenient water fixtures that provide an outdoor water source and eliminate the need for long water hoses. Typically, these hydrants are connected to buried water lines at depths ranging from 5 to 8 feet below ground level to protect the hydrant from freezing. To prevent freezing, the frost-free hydrant usually has a valve assembly with a drain port for emptying water in a hydrant head and riser pipe. However, one problem is that dirt, debris, and silt can build up and compact around the critical drain port, which causes essential drainage to be impeded and eventually stopped. This leads to poor performance, a shortened hydrant life, and replacement costs. Hence, there is a need for a system that allows for proper drainage and eliminates build-up around the drain port of a frost-free hydrant. The present invention features a frost-free hydrant drainage system for prolonging the life of a frost-free hydrant by ensuring drainage of the hydrant.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a frost-free hydrant drainage system for prolonging the life of a frost-free hydrant by ensuring drainage of the frost-free hydrant. In some embodiments, the system comprises a frost-free hydrant with a hydrant drainage boot. Exemplary embodiments of the frost-free hydrant may comprise a linear riser pipe having a pipe top end and a pipe bottom end, a pivoting operating lever having a spigot a valve having a drain port, and a pipe connector. Exemplary embodiments of the hydrant drainage boot may comprise a hollow boot body comprising a first half housing and a second half housing, a plurality of base drainage slots, a plurality of side drainage slots, a plurality of water drainage louvers, and a plurality of raised louvers. The hydrant drainage boot can be installed around a water supply line and the frost-free hydrant to prevent dirt and debris from blocking the drainage port, and ensures unobstructed drainage of the hydrant.

The present invention can provide a safe enclosure around a bottom valve of the frost-free hydrant. The hydrant drainage boot may have openings on its sides and bottom to allow water to percolate into the ground. In one embodiment, the hydrant drainage boot provides drainage away from the valve by utilizing chevron style drainage slots with external louvers to stop soil from entering the upper valve body, thereby eliminating material build-up around a valve drain hole that could impede or stop proper drainage. In order to withstand burial conditions, the hydrant drainage boot may have a fastening/locking mechanism disposed on its sides and bottom, and hose clamps around its input and output ports.

The hydrant drainage boot may be installed on the hydrant by assembling the hydrant drainage boot around the hydrant while on the ground surface, and then lowering the assembly underground, thereby eliminating the need for an installer to be in a trench and exposed to falling debris or sloughing side walls. The hydrant drainage boot can also stabilize the hydrant during installation.

DESCRIPTION OF PREFERRED EMBODIMENTS

Figure 1:
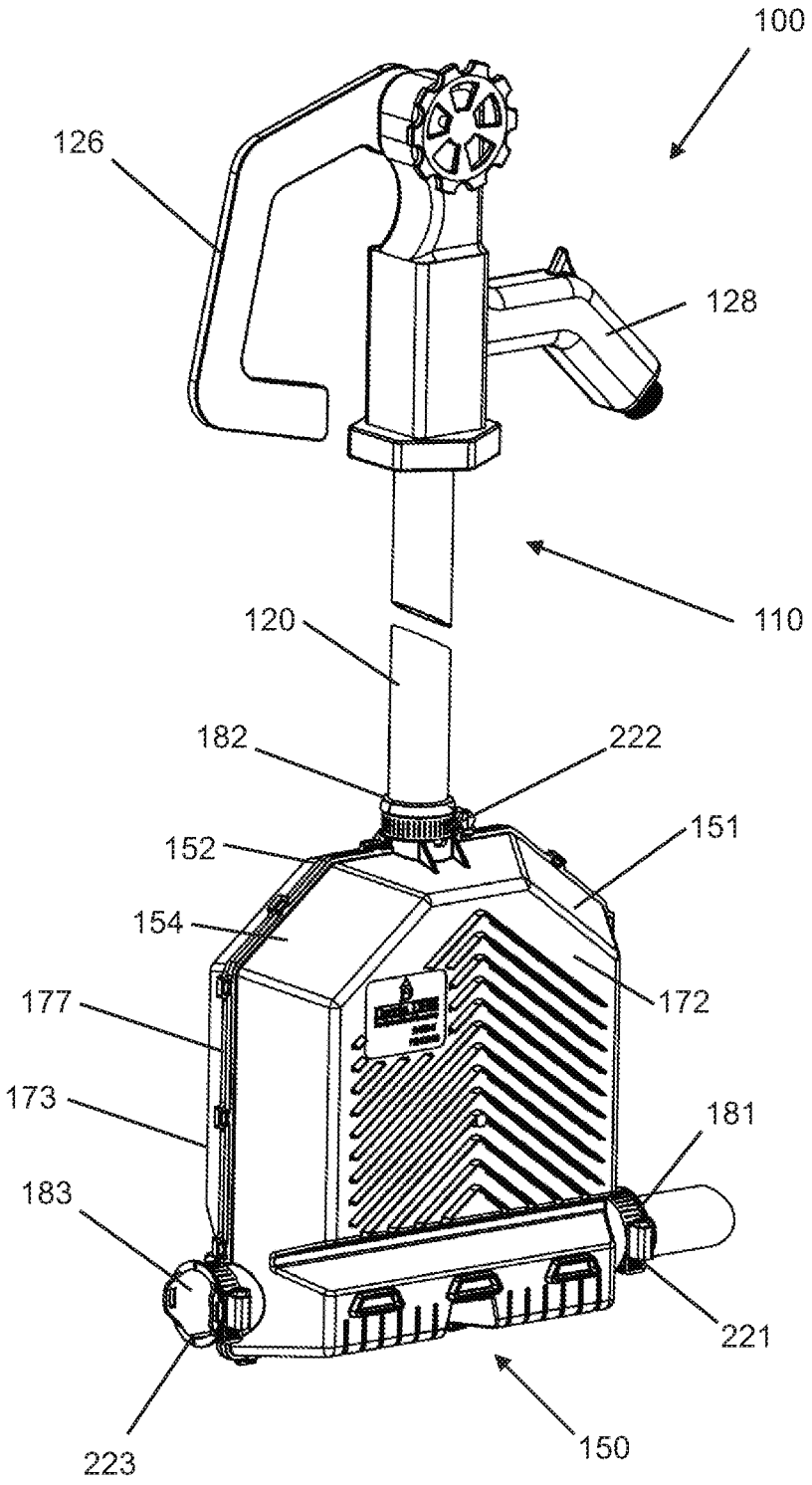
FIG. 1 shows a perspective view of the present invention.

Following is a list of elements corresponding to a particular element referred to herein:

100 frost-free hydrant drainage system
110 frost-free hydrant
120 riser pipe
122 pipe top end
124 pipe bottom end
126 pivoting operating lever
128 spigot
130 valve
132 drain port
134 pipe connector
140 water supply line
142 water supply line end
144 water outlet line
150 hydrant drainage boot
151 hollow boot body
152 first half housing
154 second half housing
156 boot cavity
157 upper chamber
158 lower chamber
159 lower chamber floor
162 internal structural support ribs
164 plurality of base drainage slots
165 plurality of side drainage slots
167 plurality of water drainage louvers
168 plurality of raised louvers
171 first side surface of the boot body
172 second side surface of the boot body
173 third side surface of the boot body

Figure 2:
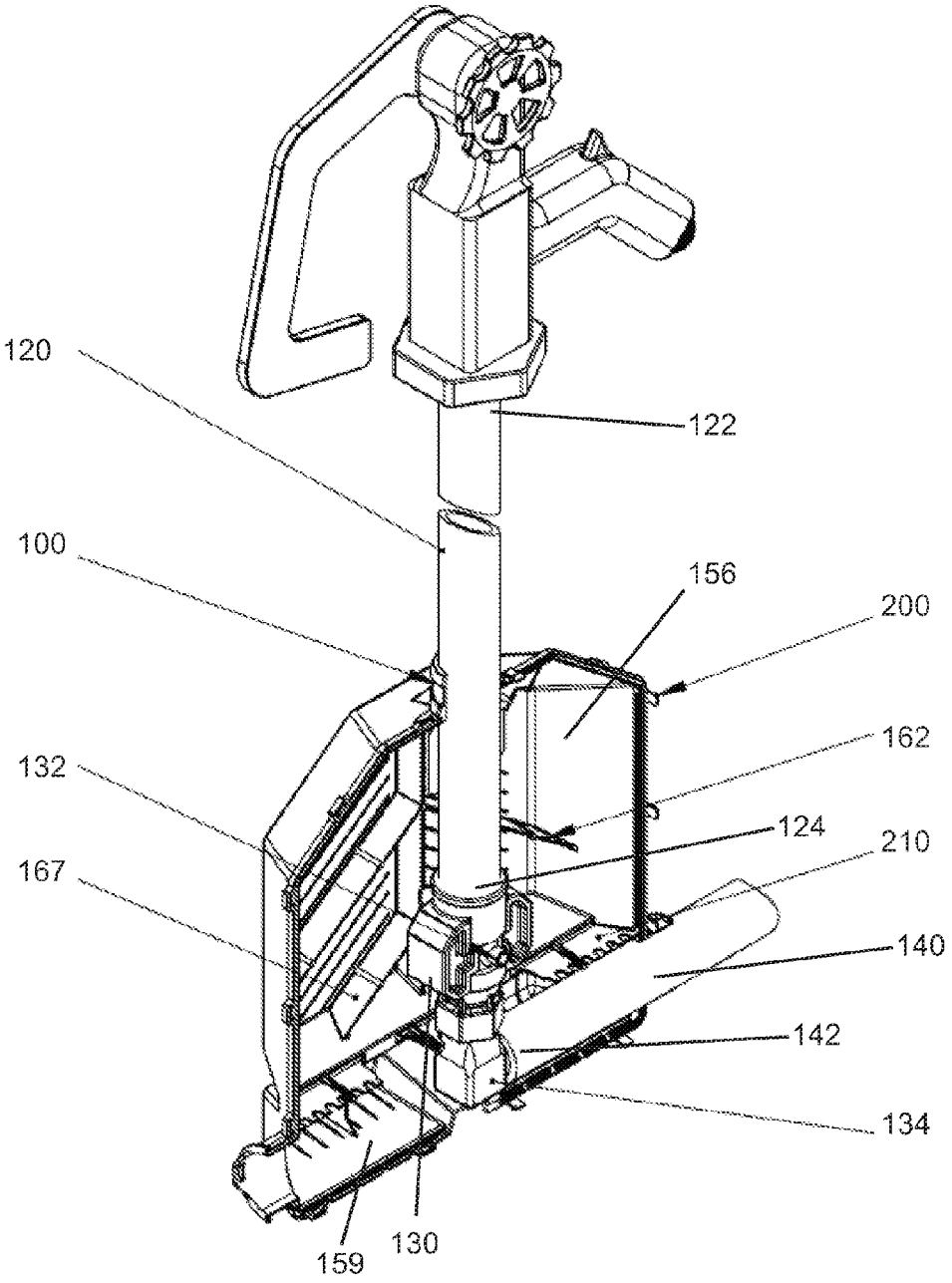
FIG. 2 shows a perspective view of the boot cavity of the hydrant drainage boot.
Figure 3:
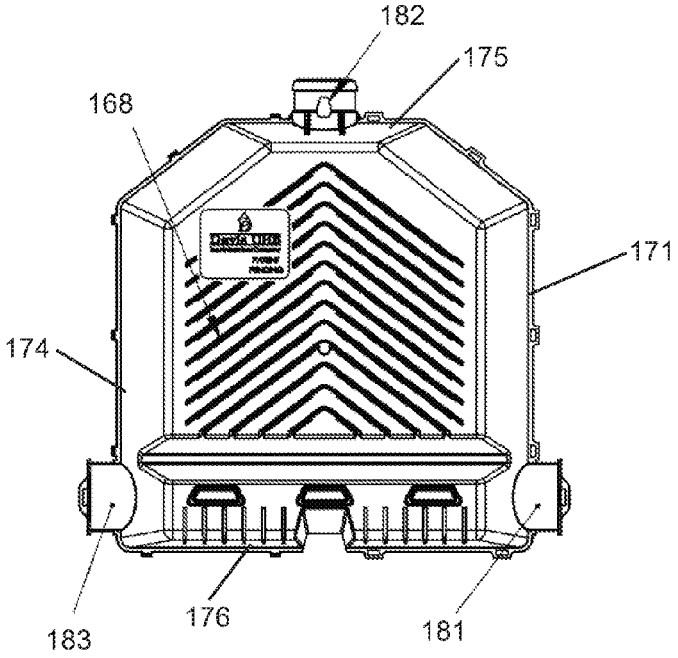
FIG. 3 shows an outer side view of the drainage boot.
Figure 4:
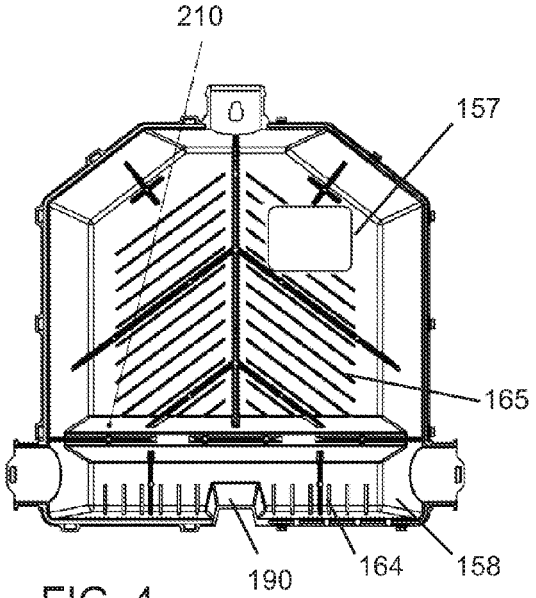
FIG. 4 shows an internal view of the boot cavity.
Figure 5:
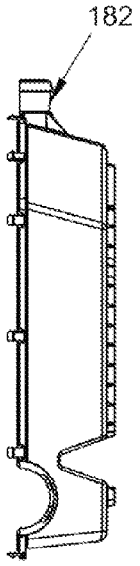
FIG. 5 shows a side view of the drainage boot.
Figure 6:
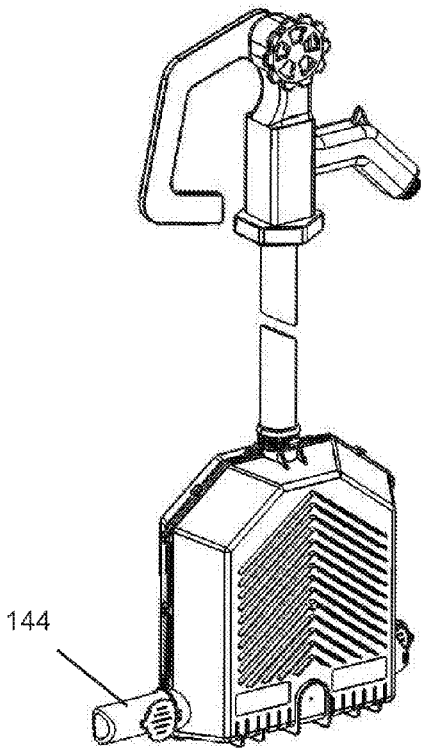
FIG. 6 shows a perspective view of an alternate embodiment of the present invention.
Figure 7:
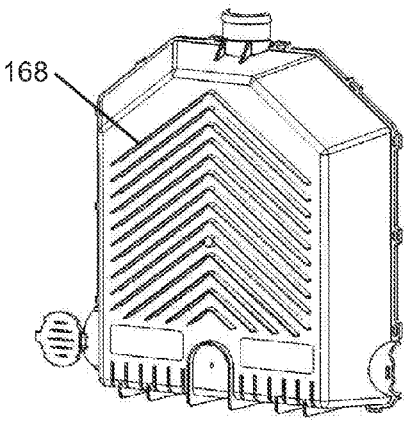
FIG. 7 shows an external perspective view of an alternate embodiment of the drainage boot.
Figure 8:
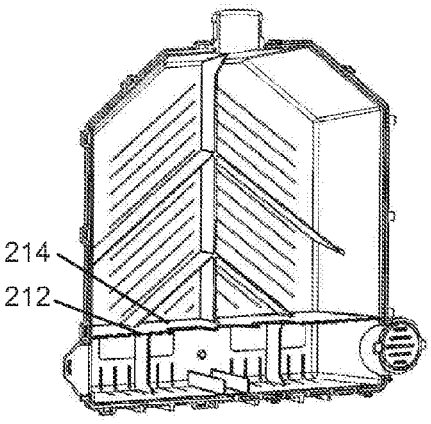
FIG. 8 shows a perspective view of an alternate embodiment of the boot cavity.

174 fourth side surface of the boot body
175 top surface of the boot body
176 bottom surface of the boot body
177 outer edge
181 first port
182 second port
183 third port
190 supporting saddle
200 plurality of hermaphroditic interlocking tabs
210 impediment plate
212 plurality of holes
214 plate opening
221 first hose clamp
222 second hose clamp
223 third hose clamp Referring now to FIGS. 1-8, the present invention features a frost-free hydrant drainage system (100) for prolonging the life of a frost-free hydrant (110) by ensuring drainage of the frost-free hydrant (110). In some embodiments, the system (100) comprises a frost-free hydrant (110) with a hydrant drainage boot (150). Exemplary embodiments of the frost-free hydrant (110) may comprise a linear riser pipe (120) having a pipe top end (122) and a pipe bottom end (124), a pivoting operating lever (126) having a spigot (128), a valve (130) having a drain port (132), and a pipe connector (134). In preferred embodiments, the hydrant drainage boot (150) comprises a hollow boot body (151) comprising a first half housing (152) and a second half housing (154), a plurality of base drainage slots (164), a plurality of side drainage slots (165), a plurality of water drainage louvers (167), and a plurality of raised louvers (168). The hydrant drainage boot (150) can be installed around a water supply line (140) and the frost-free hydrant (110) to prevent dirt and debris from blocking the drainage port (132), and ensures unobstructed drainage of the hydrant.

In some embodiments, the operating lever (126) and spigot (128) is disposed on the pipe top end (122). The valve (130) may be disposed on the pipe bottom end (124) and operatively connected to the operating lever (126). The valve (130) dually functions to regulate water incoming from a water supply line (140) and to drain water from the riser pipe (120) through the drain port (132). In other embodiments, the pipe connector (134) may be disposed beneath the valve (130) such that the valve (130) is disposed between the pipe bottom end (124) and the pipe connector (134). The pipe connector (134) may be fluidly connected to the valve (130) to allow for the water supply line (140) to be fluidly connected to the hydrant (110).

In some embodiments, the first half housing (152) and the second half housing (154) can removeably attach to form the hollow boot body (151) with a boot cavity (156) disposed therein. In preferred embodiments, the first half housing (152) and the second half housing (154) attach via a plurality of hermaphroditic interlocking tabs (200) disposed on the outer edge (177) of the first half housing (152) and the second half housing (154). In alternate embodiments, the first half housing (152) and the second half housing (154) are pivotably attached and lock together via interlocking tabs.

In some embodiments, the boot cavity (156) may comprise an upper chamber (157) and a lower chamber (158). Preferably, an impediment plate (210) is disposed in the boot cavity (156) to separate the upper chamber (157) from the lower chamber (128). Embodiments of the impediment plate (210) may comprise a plurality of holes (212) disposed thereon. Dirt and water may be collected on the impediment plate (210) and removed from the boot cavity (156) via the plurality of holes (212) and side drainage slots (165).

In some embodiments, the valve (130) and a portion of the riser pipe (120) near the pipe bottom end (124) may be disposed in the upper chamber (157). In other embodiments, the pipe connector (134) and a water supply line end (142) may be disposed in the lower chamber (158). Preferably, the pipe connector (134) and water supply line end (142) may rest upon a supporting saddle (190) offset from a lower chamber floor (159). In other embodiments, a portion of the pipe connector (134) may pass through a plate opening (214) of the impediment plate (210) and be disposed in the upper chamber (157). In still further embodiments, the upper chamber (157) may comprise internal structural support ribs (162) for providing additional support and reinforcement to the boot body (151).

In some embodiments, the water supply line (140), the hydrant drainage boot (150), and the portions of the frost-free hydrant (110) disposed within the hydrant drainage boot (150) are buried below the frost line. For example, the frost line may be about 3-8 ft below ground level.

In one embodiment, the hydrant drainage boot (150) may further comprise a first port (181) projecting outwardly and away from a first side surface (171) of the boot body (151) near the lower chamber (158). The first port (181) is fluidly connected to the lower chamber (158) to allow for the water supply line (140) to pass through the first port (181) and connect to the pipe connector (134). A first hose clamp (221) may be disposed around the first port (181) for securely fastening the water supply line (142) to the hydrant drainage boot (150).

In another embodiment, the hydrant drainage boot (150) may further comprise a second port (182) projecting outwardly and away from a top surface (175) of the boot body (151). The second port (182) is fluidly connected to the upper chamber (157) to allow for the riser pipe to pass through the second port (182). A second hose clamp (222) may be disposed around the second port (182) for securely fastening the riser pipe (120) to the hydrant drainage boot (150) to impede dirt and debris from entering the upper chamber (157).

In still a further embodiment, the hydrant drainage boot (150) may comprise a third port (183) disposed on a fourth side surface (174) opposite of the first side surface (171). The third port (183) may be direct in-line with the first port (181) and fluidly connected to the lower chamber (158) to allow for a water outlet line (144) to pass through the third port (183) and connect to the pipe connector (134). A third hose clamp (223) may be disposed around the third port (183) for securely fastening the water outlet line (144) to the hydrant drainage boot (150).

In some embodiments, the first port (181) and the third port (183) may each have a port plug to close-off a port that is not in use. For example, an exemplary scheme may only utilize a water supply line; therefore the third port (183) can be closed-off with a port plug. In some embodiments, the pipe connector (134) is an angled fitting, such as a 90° elbow fitting. This type of fitting is suitable for systems using only the water supply line. In other embodiments, the pipe connector (134) is a tee fitting. The tee fitting is suitable for systems that use both a water supply line and a water outlet line. In other embodiments, the first port (181), second port (182), and third port (183) project a sufficient distance away from the sides of the boot body (150) to accommodate the hose clamp. For example, the ports may project up to 3 inches away from the boot body. As another example, the ports may project at least ½ inch from the boot body.

In some embodiments, the plurality of base drainage slots (164) may be disposed on a bottom surface (176) of the boot body (151). In other embodiments, the plurality of side drainage slots (165) may be disposed through a second side surface (172) and an opposing third side surface (173) of the boot body (151). For example, each side drainage slot (165) may be positioned at a downward angle. As used herein, a downward angle is defined as an angle that directs dirt and/or water to flow to the bottom surface of the boot body. In still further embodiments, the plurality of side drainage slots (165) is angled to form a "V" shape pattern, wherein each vertex of the "V" shape is biased towards the top surface (175) of the boot body (151).

In some embodiments, the plurality of water drainage louvers (167) are internally disposed in the upper chamber (157). The internal water drainage louvers (167) can be disposed along the second side surface (172) and the third side surface (173) and angled downwardly. In other embodiments, the plurality of raised louvers (168) is externally disposed on the boot body (151). Preferably, the raised louvers (168) may be disposed along the second side surface (172) and the third side surface (173) such that each raised louver (168) is positioned over each side drainage slot (165) at the same downward angle as the side drainage slots (165). Water can drain from the side drainage slots (165) while the external raised louvers (168) can prevent soil intrusion.

In some embodiments, the riser pipe (120) has a length sufficient to position the pipe bottom end (124) beneath a frost line and to position the pipe top end (122) offset from a ground surface upon installation. Exemplary lengths of the riser pipe may be between about 4 ft to 8 ft in length. For example, a riser pipe may have a length of about 6 ft to allow for the riser pipe to be buried about 3 feet underground.

Embodiments of the hydrant drainage boot (150) may be constructed from durable and non-corrosive materials. Exemplary materials include plastics such as polyethylene or polypropylene.

Another embodiment of the present invention may feature a frost-free hydrant drainage boot (150) that prevents dirt and debris from blocking a drainage port (132) of the valve, and ensures unobstructed drainage of the hydrant (110). The drainage boot (150) may comprise a hollow boot body (151) comprising a first half housing (152) and a second half housing (154), a first port (181) projecting outwardly away from a first side surface (171) of the boot body (151) near the lower chamber (158), a second port (182) projecting outwardly and away from a top surface (175) of the boot body (151), a plurality of base drainage slots (164) disposed on a bottom surface (176) of the boot body (151), a plurality of side drainage slots (165) disposed through a second side surface (175) and an opposing third side surface (173) of the boot body (151), a plurality of water drainage louvers (167) internally disposed in the upper chamber (157), and a plurality of raised louvers (168) externally disposed on the boot body (151), wherein each raised louver (168) is positioned over each side drainage slot (165).

In one embodiment, the first half housing (152) and the second half housing (154) removeably attached to form the hollow boot body (151) with a boot cavity (156) disposed therein. The first half housing (152) and the second half housing (154) can attach via a plurality of hermaphroditic interlocking tabs (200) disposed on the outer edge (177) of the first half housing (152) and the second half housing (154). The drainage boot (150) may further comprise an impediment plate (210) that separates the boot cavity (156) into an upper chamber (157) and a lower chamber (158). The first port (181) may be fluidly connected to the lower chamber (158) and the second port (182) may be fluidly connected to the upper chamber (157). In another embodiment, the hydrant drainage boot (150) may further comprise a third port (183) disposed on a fourth side surface (174) opposite of the first side surface (171) and in-line with the first port (181).

The hydrant drainage boot (150) may be installed on the frost-free hydrant (110) by enclosing the boot body (151) around at least a valve (130), a pipe connector (134), a water supply line (140) and a portion of a riser pipe (120) of the frost-free hydrant. In one embodiment, the valve (130) and a portion of the riser pipe (120) near a pipe bottom end (124) may be disposed in the upper chamber (157). In another embodiment, the pipe connector (134) and a water supply line end (142) may be disposed in the lower chamber (158) and rest upon a supporting saddle (190) offset from a lower chamber floor (159).

In an exemplary embodiment, the water supply line (140) is disposed through the first port (181), the riser pipe (120) is disposed through the second port (182), and a water outlet line (144) is disposed through the third port (183). The water supply line (140) and water outlet line (144) may be fluidly connected to the pipe connector (134). In another embodiment, a first hose clamp (221) is disposed around the first port (181) for securely fastening the water supply line (140) to the hydrant drainage boot (150), a second hose clamp (222) is disposed around the second port (182) for securely fastening the riser pipe (120) to the hydrant drainage boot (150) to impede dirt and debris from entering the upper chamber (157), and a third hose clamp (223) is disposed around the third port (183) for securely fastening the water outlet line (144) to the hydrant drainage boot (150).

In some embodiments, the hydrant drainage boot (150) may be in a shape of a polygon, such as a rectangular prism, a cube, or a triangular box. For example, the the hydrant drainage boot (150) may be in a shape of rectangular prism with a trapezoidal box top. However, the hydrant drainage boot (150) is not limited to the aforementioned shapes, and may be any suitable shape. In other embodiments, the hydrant drainage boot (150) may have a volume that is at least twice the volume of the riser pipe.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A frost-free hydrant drainage system (100) for prolonging the life of a frost-free hydrant (110) by ensuring drainage of the frost-free hydrant (110), wherein the system (100) comprises:

a. a frost-free hydrant (110) comprising:

i. a linear riser pipe (120) having a pipe top end (122) and a pipe bottom end (124), wherein the riser pipe (120) has a length sufficient to position the pipe bottom end (124) beneath a frost line and to position the pipe top end (122) offset from a ground surface upon installation;

ii. a pivoting operating lever (126) having a spigot (128), wherein the operating lever (126) is disposed on the pipe top end (122);

iii. a valve (130) having a drain port (132), wherein the valve (130) is disposed on the pipe bottom end (124) and operatively connected to the operating lever (126), wherein the valve (130) dually functions to regulate water incoming from a water supply line (140) and to drain water from the riser pipe (120) through the drain port (132); and iv. a pipe connector (134) disposed beneath the valve (130) such that the valve (130) is disposed between the pipe bottom end (124) and the pipe connector (134), wherein the pipe connector (134) is fluidly connected to the valve (130), wherein the water supply line (140) is fluidly connected to the hydrant (110) via the pipe connector (134); and b. a hydrant drainage boot (150) comprising:

i. a hollow boot body (151) comprising a first half housing (152) and a second half housing (154), wherein the first half housing (152) and the second half housing (154) removeably attach to form the hollow boot body (151) with a boot cavity (156) disposed therein, wherein the boot cavity (156) comprises an upper chamber (157) and a lower chamber (158);

ii. a first port (181) projecting outwardly and away from a first side surface (171) of the boot body (151) at the lower chamber (158), wherein the first port (181) is fluidly connected to the lower chamber (158);

iii. a second port (182) projecting outwardly and away from a top surface (175) of the boot body (151), wherein the second port (182) is fluidly connected to the upper chamber (157);

iv. a plurality of base drainage slots (164) disposed on a bottom surface of the boot body (151);

v. a plurality of side drainage slots (165) disposed through a second side surface (172) and an opposing third side surface (173) of the boot body (151);

vi. a plurality of water drainage louvers (167) internally disposed in the upper chamber (157); and vii. a plurality of raised louvers (168) externally disposed on the boot body (151), wherein each raised louver (168) is positioned over each side drainage slot (165);

wherein the hydrant drainage boot (150) is installed around the water supply line (140) and the frost-free hydrant (110), wherein the riser pipe (120) is disposed through the second port (182), wherein the valve (130) and a portion of the riser pipe (120) that includes the pipe bottom end (124) are disposed in the upper chamber (157), wherein the water supply line (140) is disposed through the first port (181), wherein the pipe connector (134) and a water supply line end (142) are disposed in the lower chamber (158) and rest upon a supporting saddle (190) offset from a lower chamber floor (159);

wherein the water supply line (140), the hydrant drainage boot (150), and portions of the frost-free hydrant (110) disposed within the hydrant drainage boot (150) are buried below the frost line; and wherein the hydrant drainage boot (150) prevents dirt and debris from blocking the drainage port (132), and ensures unobstructed drainage of the hydrant (110).

2. The system of claim 1, wherein the hydrant drainage boot (150) is constructed from a plastic.

3. The system of claim 1, wherein the hydrant drainage boot (150) is non-corrosive.

4. The system of claim 1, wherein the first half housing (152) and the second half housing (154) attach via a plurality of hermaphroditic interlocking tabs (200) disposed on an outer edge (177) of the first half housing (152) and the second half housing (154).

5. The system of claim 1, wherein an impediment plate (210) separates the upper chamber (157) from the lower chamber (128).

6. The system of claim 5, wherein a plurality of holes (212) is disposed on the impediment plate (210).

7. The system of claim 5, wherein a portion of the pipe connector (134) passes through a plate opening (214) to be disposed in the upper chamber (157).

8. The system of claim 1, wherein the pipe connector (134) is a 90° elbow fitting.

9. The system of claim 1, wherein the hydrant drainage boot (150) further comprises a third port (183) disposed on a fourth side surface (174) opposite of the first side surface (171) and in-line with the first port (181).

10. The system of claim 9, wherein a water outlet line (144) is disposed through the third port (183) and is fluidly connected to the pipe connector (134), wherein the pipe connector (134) is a tee fitting.

11. The system of claim 1, wherein a first hose clamp (221) is disposed around the first port (181) for securely fastening the water supply line (142) to the hydrant drainage boot (150), and wherein a second hose clamp (222) is disposed around the second port (182) for securely fastening the riser pipe (120) to the hydrant drainage boot (150) to impede dirt and debris from entering the upper chamber (157).

12. The system of claim 10, wherein a third hose clamp (223) is disposed around the third port (183) for securely fastening the water outlet line (144) to the hydrant drainage boot (150).

13. The system of claim 1, wherein the upper chamber (157) comprises internal structural support ribs (162).

14. The system of claim 1, wherein the plurality of side drainage slots (165) are angled to form a "V" shape pattern, wherein each vertex of the "V" shape is biased towards the top surface (175) of the boot body (151).

15. The system of claim 1, wherein the water drainage louvers (167) and the raised louvers (168) are positioned at an angle.

16. A frost-free hydrant drainage boot (150) for ensuring drainage of a frost-free hydrant (110), wherein said drainage boot (150) comprises:

a. a hollow boot body (151) comprising a first half housing (152) and a second half housing (154), wherein the first half housing (152) and the second half housing (154) removeably attach to form the hollow boot body (151) with a boot cavity (156) disposed therein, wherein the boot cavity (156) comprises an upper chamber (157) and a lower chamber (158);

b. a first port (181) projecting outwardly and away from a first side surface (171) of the boot body (151) at the lower chamber (158), wherein the first port (181) is fluidly connected to the lower chamber (158);

c. a second port (182) projecting outwardly and away from a top surface (175) of the boot body (151), wherein the second port (182) is fluidly connected to the upper chamber (157);

d. a plurality of base drainage slots (164) disposed on a bottom surface (176) of the boot body (151);

e. a plurality of side drainage slots (165) disposed through a second side surface (175) and an opposing third side surface (173) of the boot body (151);

f. a plurality of water drainage louvers (167) internally disposed in the upper chamber (157); and g. a plurality of raised louvers (168) externally disposed on the boot body (151), wherein each raised louver (168) is positioned over each side drainage slot (165);

wherein the hydrant drainage boot (150) is enclosed around at least a valve (130), a pipe connector (134), a water supply line (140) and a portion of a riser pipe (120) of a frost-free hydrant (110), wherein the riser pipe (120) is disposed through the second port (182), wherein the valve (130) and a portion of the riser pipe (120) that includes a pipe bottom end (124) are disposed in the upper chamber (157), wherein the water supply line (140) is disposed through the first port (181), wherein the pipe connector (134) and a water supply line end (142) are disposed in the lower chamber (158) and rest upon a supporting saddle (190) offset from a lower chamber floor (159);

wherein the hydrant drainage boot (150) prevents dirt and debris from blocking a drainage port (132) of the valve, and ensures unobstructed drainage of the hydrant (110).

17. The drainage boot of claim 16, wherein the first half housing (152) and the second half housing (154) attach via a plurality of hermaphroditic interlocking tabs (200) disposed on an outer edge (177) of the first half housing (152) and the second half housing (154).

18. The drainage boot of claim 16 further comprising an impediment plate (210) separating the upper chamber (157) from the lower chamber (158).

19. The drainage boot of claim 16, wherein the hydrant drainage boot (150) further comprises a third port (183) disposed on a fourth side surface (174) opposite of the first side surface (171) and in-line with the first port (181), wherein a water outlet line (144) is disposed through the third port (183) and is fluidly connected to the pipe connector (134).

20. The drainage boot of claim 19, wherein a first hose clamp (221) is disposed around the first port (181) for securely fastening the water supply line (140) to the hydrant drainage boot (150), wherein a second hose clamp (222) is disposed around the second port (182) for securely fastening the riser pipe (120) to the hydrant drainage boot (150) to impede dirt and debris from entering the upper chamber (157), and wherein a third hose clamp (223) is disposed around the third port (183) for securely fastening the water outlet line (144) to the hydrant drainage boot (150).

* * * * *